US009932739B2

(12) United States Patent
Verhoff et al.

(10) Patent No.: US 9,932,739 B2
(45) Date of Patent: Apr. 3, 2018

(54) ROOFING MATERIAL WITH NON-ASPHALT COATING

(71) Applicant: Owens Corning Intellectual Capital, LLC, Toledo, OH (US)

(72) Inventors: Jonathan M. Verhoff, Granville, OH (US); Desmond John VanHouten, Etna, OH (US); Scott William Schweiger, Newark, OH (US)

(73) Assignee: OWENS CORNING INTELLECTUAL CAPITAL, LLC, Toledo, OH (US)

( * ) Notice: Subject to any disclaimer, the term of this patent is extended or adjusted under 35 U.S.C. 154(b) by 0 days.

(21) Appl. No.: 15/245,406

(22) Filed: Aug. 24, 2016

(65) Prior Publication Data

US 2017/0058528 A1 Mar. 2, 2017

Related U.S. Application Data

(60) Provisional application No. 62/208,936, filed on Aug. 24, 2015.

(51) Int. Cl.

| | |
|---|---|
| ***E04D 1/28*** | (2006.01) |
| ***B05D 1/02*** | (2006.01) |
| ***B05D 1/16*** | (2006.01) |
| ***B05D 1/28*** | (2006.01) |
| ***B05D 1/30*** | (2006.01) |
| ***B05D 1/36*** | (2006.01) |
| ***B05D 3/02*** | (2006.01) |
| ***B05D 3/12*** | (2006.01) |

(Continued)

(52) U.S. Cl.

CPC ..... *E04D 1/28* (2013.01); *B05D 1/02* (2013.01); *B05D 1/16* (2013.01); *B05D 1/28* (2013.01); *B05D 1/30* (2013.01); *B05D 1/36* (2013.01); *B05D 3/0272* (2013.01); *B05D 3/12* (2013.01); *E04D 1/20* (2013.01); *B05D 5/02* (2013.01)

(58) Field of Classification Search

CPC . E04D 1/26; E04D 2001/005; B32B 2395/00; B32B 2419/06; B32B 2037/243; D06N 5/00

See application file for complete search history.

(56) References Cited

U.S. PATENT DOCUMENTS

| | | | |
|---|---|---|---|
| 4,129,674 | A | 12/1978 | Hannes et al. |
| 4,188,763 | A | 2/1980 | Thiis-Evensen |
| 4,195,461 | A | 4/1980 | Thiis-Evensen |

(Continued)

FOREIGN PATENT DOCUMENTS

| | | |
|---|---|---|
| WO | 2008/150944 | 12/2008 |

OTHER PUBLICATIONS

International Search Report and Written Opinion PCT/US16/48291 dated Oct. 25, 2016.

(Continued)

*Primary Examiner* — Rodney Mintz
*Assistant Examiner* — Daniel J Kenny
(74) *Attorney, Agent, or Firm* — Calfee, Halter & Griswold LLP

(57) ABSTRACT

A roofing material including a substrate having a top face and a bottom face. The roofing material further includes a non-asphalt coating applied to the substrate and an asphalt layer covering at least a portion of the top face. The bottom face is asphalt-free, or substantially asphalt-free.

4 Claims, 6 Drawing Sheets

(51) Int. Cl.
*E04D 1/20* (2006.01)
*B05D 5/02* (2006.01)

(56) References Cited

U.S. PATENT DOCUMENTS

| | | | | |
|---|---|---|---|---|
| 4,317,853 | A | 3/1982 | Thiis-Evensen | |
| 4,352,837 | A | 10/1982 | Kopenhaver | |
| 4,357,377 | A | 11/1982 | Yamamoto | |
| 4,542,068 | A | 9/1985 | Whichard | |
| 4,636,414 | A | 1/1987 | Tajima et al. | |
| 4,917,764 | A | 4/1990 | Lalwani et al. | |
| 5,104,712 | A * | 4/1992 | Walters | A63C 19/04 428/314.4 |
| 5,484,653 | A | 1/1996 | Kennedy et al. | |
| 5,516,573 | A | 5/1996 | George et al. | |
| 5,624,522 | A | 4/1997 | Belt et al. | |
| 5,965,257 | A | 10/1999 | Ahluwalia | |
| 6,296,912 | B1 | 10/2001 | Zickell | |
| 6,341,462 | B2 | 1/2002 | Kiik et al. | |
| 6,531,200 | B2 | 3/2003 | Zickell et al. | |
| 6,936,329 | B2 | 8/2005 | Kiik et al. | |
| 7,048,990 | B2 | 5/2006 | Koschitzky | |
| 7,805,909 | B2 | 10/2010 | Teng et al. | |
| 7,851,051 | B2 | 12/2010 | DeJarnette et al. | |
| 7,923,107 | B2 | 4/2011 | Thomas et al. | |
| 7,923,108 | B2 | 4/2011 | Thomas et al. | |
| 8,277,949 | B2 | 10/2012 | Smith | |
| 8,334,224 | B2 | 12/2012 | Thomas et al. | |
| 8,389,103 | B2 | 3/2013 | Kiik et al. | |
| 8,697,783 | B2 | 4/2014 | Smith | |
| 8,713,883 | B2 | 5/2014 | Thies, III | |
| 8,898,963 | B1 | 12/2014 | Amatruda et al. | |
| 8,898,987 | B1 | 12/2014 | Amatruda et al. | |
| 8,925,272 | B1 | 1/2015 | Amatruda et al. | |
| 2005/0284070 | A1 | 12/2005 | Binkley et al. | |
| 2007/0261337 | A1 | 11/2007 | Whitaker et al. | |
| 2011/0230111 | A1 | 9/2011 | Weir et al. | |
| 2013/0025225 | A1 | 1/2013 | Vermilion et al. | |
| 2014/0259820 | A1 | 9/2014 | Humphreys et al. | |
| 2015/0368904 | A1 | 12/2015 | Humphreys | |

OTHER PUBLICATIONS

Inquiring Eye Home Inspects, LLC, Roofing, Written by Randy Howland, obtained from worldwide web, inquiriing-eye.com, printed Apr. 2, 2014, 9 pgs.

* cited by examiner

ROOFING MATERIAL WITH NON-ASPHALT COATING

RELATED APPLICATIONS

The present application claims the benefit of U.S. Provisional Patent Application Ser. No. 62/208,936, filed on Aug. 24, 2015, the disclosure of which is incorporated herein by reference in its entirety.

FIELD OF INVENTION

The present invention relates generally to the field of roofing materials and more particularly to asphalt-based roofing materials with a substrate coating material applied to the completed substrate instead of some of the roofing asphalt.

BACKGROUND

Asphalt-based roofing materials, such as roofing shingles, are installed on the roofs of buildings to provide protection from the elements and to give the roof an aesthetically pleasing look. Typically, the roofing shingles are constructed on a completed substrate, such as, for example, a glass fiber mat. A roofing shingle is constructed by coating the completed substrate with asphalt such that the asphalt saturates the substrate and forms an asphalt layer on both the top face and bottom face of the substrate. A decorative/protective surface layer of granules are applied in the asphalt layer on the top face of the completed substrate and a coating of sand or other particulate material is adhered to the asphalt layer on the bottom face of the substrate. The weight of and the ability to control the weight of the shingle during manufacturing, the cost of manufacturing the shingle, and the performance characteristics of the shingle are significantly impacted by the amount of asphalt and surface layers applied to the substrate.

SUMMARY

The present disclosure includes exemplary embodiments of asphalt based roofing materials where a substrate coating material is applied to the completed substrate instead of some of the roofing asphalt. The roofing material includes a completed substrate having a top face and a bottom face. The roofing material includes an asphalt layer covering at least a portion of the top face, and a surface layer of granules adhered to the asphalt layer. During manufacturing of the roofing material, the bottom face of the completed substrate is coated with a non-roofing asphalt coating. As such, the bottom face of the substrate in the finished roofing shingle is asphalt-free or substantially asphalt-free.

BRIEF DESCRIPTION OF THE SEVERAL VIEWS OF THE DRAWINGS

The accompanying drawings, which are incorporated in and constitute a part of this specification, illustrate some embodiments disclosed herein, and together with the description, serve to explain principles of the embodiments disclosed herein.

DETAILED DESCRIPTION

The present invention will now be described with occasional reference to the illustrated embodiments of the invention. This invention may, however, be embodied in different forms and should not be construed as limited to the embodiments set forth herein, nor in any order of preference. Rather, these embodiments are provided so that this disclosure will be more thorough, and will convey the scope of the invention to those skilled in the art.

Unless otherwise defined, all technical and scientific terms used herein have the same meaning as commonly understood by one of ordinary skill in the art to which this invention belongs. The terminology used in the description of the invention herein is for describing particular embodiments only and is not intended to be limiting of the invention. As used in the description of the invention and the appended claims, the singular forms "a," "an," and "the" are intended to include the plural forms as well, unless the context clearly indicates otherwise.

Unless otherwise indicated, all numbers expressing quantities of ingredients, properties such as molecular weight, reaction conditions, and so forth as used in the specification and claims are to be understood as being modified in all instances by the term "about." Accordingly, unless otherwise indicated, the numerical properties set forth in the specification and claims are approximations that may vary depending on the desired properties sought to be obtained in embodiments of the present invention. Notwithstanding that the numerical ranges and parameters setting forth the broad scope of the invention are approximations, the numerical values set forth in the specific examples are reported as precisely as possible. Any numerical values, however, inherently contain certain errors necessarily resulting from error found in their respective measurements.

As used in the description and the appended claims, the phrase "asphalt" is defined as any type of bituminous material suitable for use on a roofing material, such as asphalts, tars, pitches, or mixtures thereof. The asphalt may be either manufactured asphalt produced by refining petroleum or naturally occurring asphalt. The asphalt may include various additives and/or modifiers, such as inorganic fillers or mineral stabilizers, organic materials such as polymers, recycled streams, or ground tire rubber. Preferably, the asphalt contains asphalt and an inorganic filler or mineral stabilizer.

As used in the description of the invention and the appended claims, the term "longitudinal" or "longitudinally" is defined as parallel with the machine direction or substantially parallel with the machine direction. The terms "top" and "bottom", when used regarding the roofing material, are in reference to the roofing material when installed on a roof "Bottom" referring to the portion facing towards the roof deck and "top" referring to the portion facing away from the roof deck.

Figure 1:
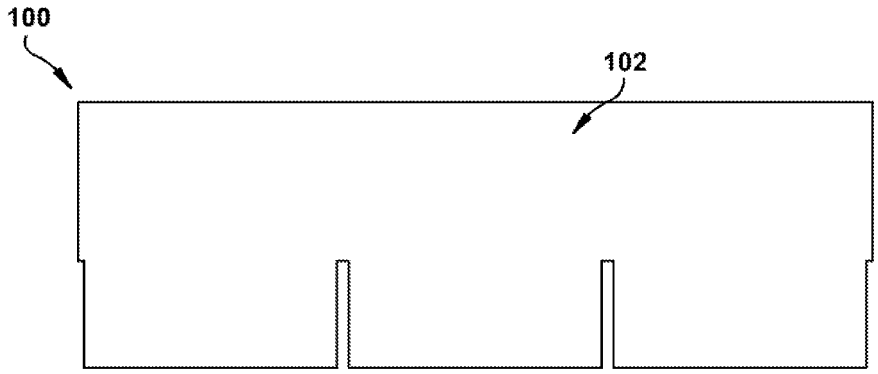
Figure 1 (Prior Art)
FIG. 1 is a top view of a prior art shingle.
Figure 2:
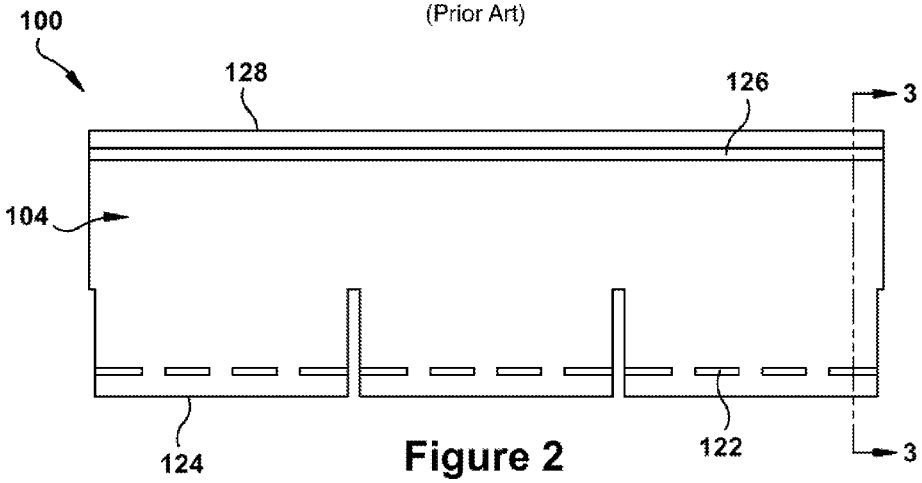
Figure 2 (Prior Art)
FIG. 2 is a bottom view of the shingle of FIG. 1.
Figure 3:
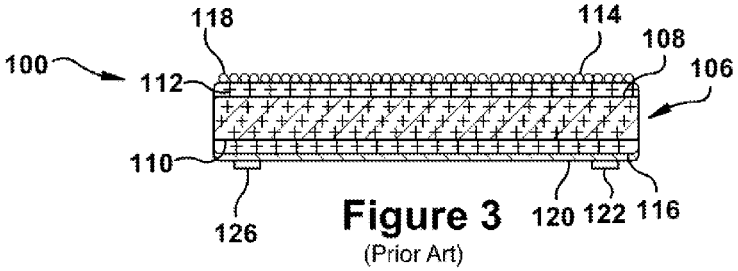
Figure 3 (Prior Art)
FIG. 3 is a side section view of the shingle of FIG. 1.

Asphalt-based roofing materials, such as asphalt shingles, are commonly used in roofing applications. FIGS. 1-3 illustrate a typical prior art asphalt shingle 100 having a top surface 102 and a bottom surface 104. The shingle 100 includes a substrate 106, such as a fiberglass mat, that includes a top face 108 and a bottom face 110. During manufacturing of the shingle, the completed substrate 106 is coated with hot, melted asphalt 112. The asphalt 112 saturates the completed substrate 106 and forms a top asphalt layer 114 on the top face 108 of the substrate 106 and a bottom asphalt layer 116 on the bottom face 110 of the substrate. A layer of granules 118 covers the top asphalt layer 114 and a backing coating layer 120, such as sand or mica, covers the bottom asphalt layer 116. Often, a continuous or discontinuous bead of tab sealant 122, such as a modified asphalt adhesive, may be applied to the front side or the back side of the shingle and extend longitudinally adjacent and parallel a leading edge 124. In FIG. 2, the tab sealant is applied to the back side of the shingle and is configured to adhere to an underlying shingle when installed on a roof.

When shingles are stacked for packaging and storage, two shingles may be placed back-to-back with one shingle rotated 180 degrees. The back coating layer 120 is applied so that the bottom asphalt layer 116 does not adhere to the bottom asphalt layer of the adjacent shingle when the shingles are stacked. Placing the shingles back-to-back avoids the tab sealant 122 sticking to and damaging the granular layer 118 on the top asphalt layer 114 of the shingle 100. Rotating the shingles 180 degrees avoids the tab sealant 122 adhering to the tab sealant on the adjacent shingle.

If desired, a continuous strip of release tape 126, typically polyethylene terephthalate (PET) tape, may be adhered to the back side of the shingle 100 adjacent to and parallel to a trailing edge 128. The release tape 126, to which the sealant will not stick, is positioned such that it will be aligned with the tab sealant of an adjacent shingle when the shingles are stacked. In some cases, instead of being placed back-to-back when stacked for packaging and storage, shingles may be stacked face to back. In such a case, the release tape is applied to the top of the shingles and provides the same function of preventing the tab sealant from adhering to the adjacent shingle.

Figure 4:
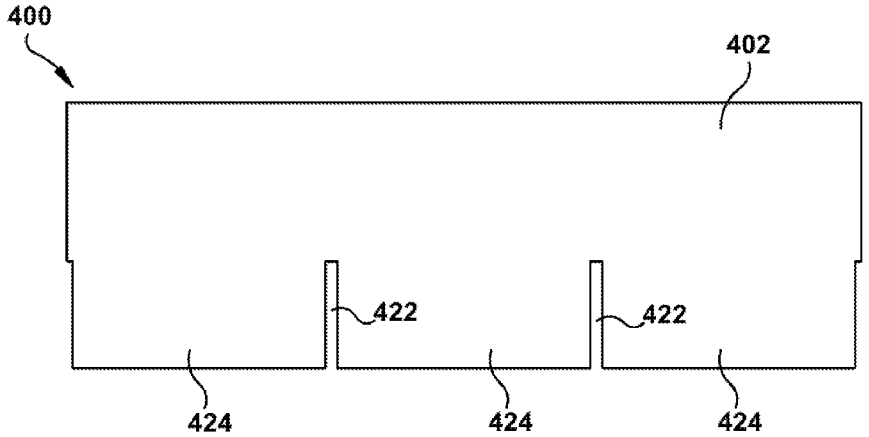
FIG. 4 is a top view of an exemplary embodiment of a roofing shingle according to the present invention.
Figure 5:
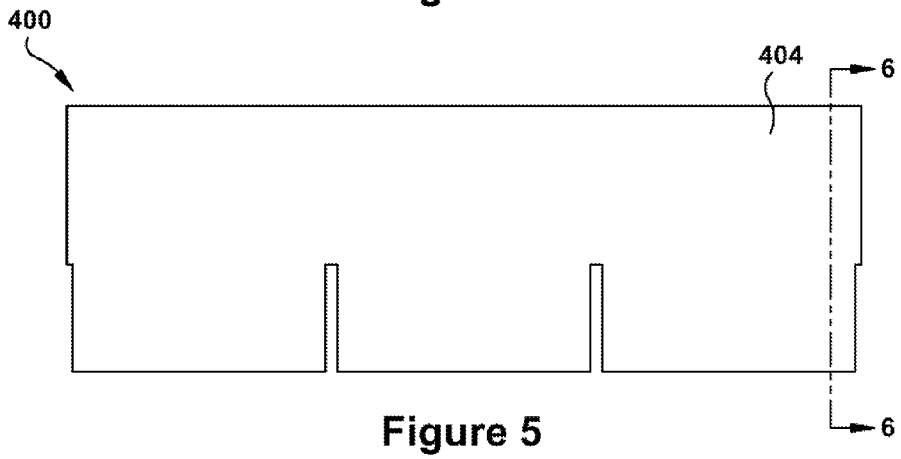
FIG. 5 is a bottom view of the shingle of FIG. 4.
Figure 6:
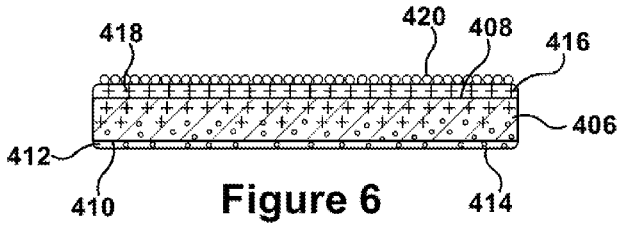
FIG. 6 is a side section view of the shingle of FIG. 4.

FIGS. 4-6 illustrate an exemplary embodiment of a shingle 400 according to the present disclosure. The general inventive concepts, however, are not limited to shingles and could be readily extended to other asphalt-based roofing materials. The shingle 400 is generally planar and includes a top surface 402 and a bottom surface 404. The shingle 400 includes a substrate 406 having a top face 408 and a bottom face 410 generally parallel to the top face. The substrate 406 may be any material suitable for use in asphalt-based roofing materials. Suitable materials may include, but not be limited to, a fiberglass mat, a scrim or felt of fibrous materials such as mineral fibers, cellulose fibers, rag fibers, mixtures of mineral and synthetic fibers, or the like. In the exemplary embodiment, the substrate 406 is a non-woven web of glass fibers.

In the example illustrated by FIGS. 4-6, a substitute coating material is applied to the completed substrate instead of some of the roofing asphalt of the shingle 400. The non-asphalt coating 412 may include a variety of substances and additives. Any coating that enables the completed substrate 406 to function as a reinforcing member as well or better than when the completed substrate 406 is coated with roofing asphalt may be used. In the example illustrated by FIG. 6, the coating 406 is substituted for the asphalt on the bottom face 410 of the substrate 406. In some cases, the coating 412 also substitutes for the asphalt in the mat, so there is less asphalt impregnation of the mat, little asphalt impregnation of the mat, or no asphalt impregnation of the mat. The coating 412 may be configured to improve one or more properties of the shingle 400. For example, the non-asphalt coating 412 may improve, but not be limited to improving, the shingle's tear resistance, tensile strength, shingle stiffness, nail pull resistance, wind resistance, fire/burn resistance, cold curling resistance, masking ability (i.e. the ability of the shingle to mask imperfections in the roofing deck), and water shedding ability (in the package and on the roof). Suitable substances or additives for use in the non-asphalt coating 412 may include, but not be limited to, one or more of a filler, such as calcium carbonate, viscosity modifiers, dispersants, biocides, acrylic resins, clays, wollastonite, water repellants, or powdered resins such as powdered polyvinyl chloride (PVC), polypropylene, polyethylene, binders, such as latex binders, toners or colorants, and non-roofing asphalt.

In one exemplary embodiment, the coating 412 consists essentially of calcium carbonate, dispersant, latex binder, colorant, viscosity modifier, and/or biocide. In one exemplary embodiment, the coating 412 includes 90-96% calcium carbonate, 0-0.5% dispersant, 4-8% latex binder, 0-3% colorant, 0-0.5% viscosity modifier, and 0-0.25% biocide. In one exemplary embodiment, the coating 412 includes 91.5-92% calcium carbonate, 0.1-0.2% dispersant, 6-7.5% latex binder, 0.5-1.5% colorant, 0.1-0.2% viscosity modifier, and 0.05-0.15% biocide. In one exemplary embodiment, the coating 412 includes 93-95% calcium carbonate, 0.05-0.15% dispersant, 5.5-6.5% latex binder, 0-0.5% colorant, 0.05-0.15% viscosity modifier, and 0-0.05% biocide. In one exemplary embodiment, the coating 412 includes about 92% calcium carbonate, about 0.15% dispersant, about 7% latex binder, about 1% colorant, about 0.15% viscosity modifier, and about 0.1% biocide. In one exemplary embodiment, the coating 412 includes about 94% calcium carbonate, about 0.1% dispersant, about 6% latex binder, and about 0.1% viscosity modifier.

The coating 412 can be applied to impregnate the previously completed substrate 406 fully, partially, or not at all and thereby be substituted for all, some, or none of the asphalt that is applied to the top surface 408. In this context, impregnation and substitution of roofing asphalt refer to filling the void or space between the fibers in the completed substrate 406. For example, in the exemplary embodiment, the substrate 406 is a fiberglass mat. A completed, uncoated, non-woven fiberglass mat is essentially a web of glass fibers held together by a cured binder, but the majority of the space taken up by the completed fiberglass mat is air. Fully impregnating the completed mat or completely substituting a coating for the roofing asphalt in the mat means that all of the air space or substantially all of the air space, such as for example greater than 95% of the air space, between the glass fibers is filled with the coating while partially impregnating the mat or partially substituting a coating for the roofing asphalt in the mat with a coating means that some of the air space, such as for example less than 95% of the air space, between the glass fibers is filled.

The coating 412 can also be applied to substitute for the asphalt in the substrate 406 such that a discrete coating layer is formed on the top face 408, on the bottom face 410, or on both the faces. Depending on the application, the coating may be substituted for the roofing asphalt such that the shingle 400 may (i) have non-asphalt coating that impregnates the substrate and also forms a discrete layer on one or both faces, (ii) have a discrete non-asphalt coating layer on one face but the non-asphalt coating does not impregnate the substrate, (iii) have non-asphalt coating that impregnates the substrate but no discrete non-asphalt coating layer forms on either the top face or the bottom face, (iv) or have some other combination of impregnation/coating substitution and discrete layers.

In the shingle illustrated by FIGS. 4-6, at least a portion of the bottom face 410 of the substrate 406 is coated with non-asphalt coating 412 such that the non-asphalt coating forms a discrete bottom layer 414 on the bottom face 410 and partially impregnates the substrate 406. As such, coating 412 is substituted for the roofing asphalt on the bottom 410 and coating 412 is substituted for a portion of the roofing asphalt that penetrates the mat. In addition, in the embodiments illustrated by FIGS. 4-6, at least a portion of the top face 408 of the substrate 406 is coated with asphalt 416 such that the asphalt forms a discrete top asphalt layer 418 on the top face 408 and also partially impregnates the substrate 406. In one exemplary embodiment, all of the bottom face 410 is coated with non-asphalt coating 412 and all of the top face 408 is coated with asphalt 416. In another exemplary embodiment, substantially all, such as for example greater than 95%, of the bottom face 410 is coated with non-asphalt coating 412 and substantially all, such as for example greater than 95% of the top face 408 of the substrate 406 is coated with asphalt 416. The combination of the non-asphalt coating 412 impregnating the substrate 406 and the asphalt 416 impregnating the substrate results in the substrate being fully impregnated, or substantially fully impregnated. The bottom face 410 of the substrate 406, however, is asphalt-free, or substantially asphalt-free.

The shingle 400 includes a layer of granules 420 that covers, and may be partially embedded into, the top asphalt layer 418. The layer of granules 420 may be configured to include a variety of materials, shapes, colors, and sizes. Any granules suitable for use on the top face of an asphalt-based roofing shingle may be used. The shingle 400 does not include a coating of asphalt on the bottom face 410. The absence of an asphalt coating on the bottom face 410 may decrease the chance of the shingle sticking to an adjacent shingle when the shingles are packaged for transport and storage. In addition, the need for a backing coating of sand or mica may be eliminated.

The completed substrate 406 may be formed by any suitable process, many of which are already known in the art. For example, in the exemplary embodiment, the fiberglass substrate 406 may be formed by a wet-laid process, as is known in the art. Generally, a wet-laid process involves adding glass fibers to a dispersant medium to form an aqueous slurry. Any suitable dispersant may be used. The dispersant, along with mechanical agitation, disperses the fibers sufficiently throughout the slurry. A continuous fine mesh screen passes through the fiber slurry such that the fibers are randomly deposited onto the screen to form a continuous non-woven web. Any excess liquid may be removed by vacuum or other suitable manner. The non-woven web is then saturated with a binder solution. Any suitable thermosetting or thermoplastic binder may be used, such as for example, traditional phenolic-formaldehyde binders, as well as the more recent formaldehyde-free binders, including polyacrylic binders and carbohydrate, starch or bio-based binders. The binder-saturated web then passes through an oven that is heated to a suitable temperature to cure the binder and form the complete dry fiberglass substrate 406.

Figure 7:
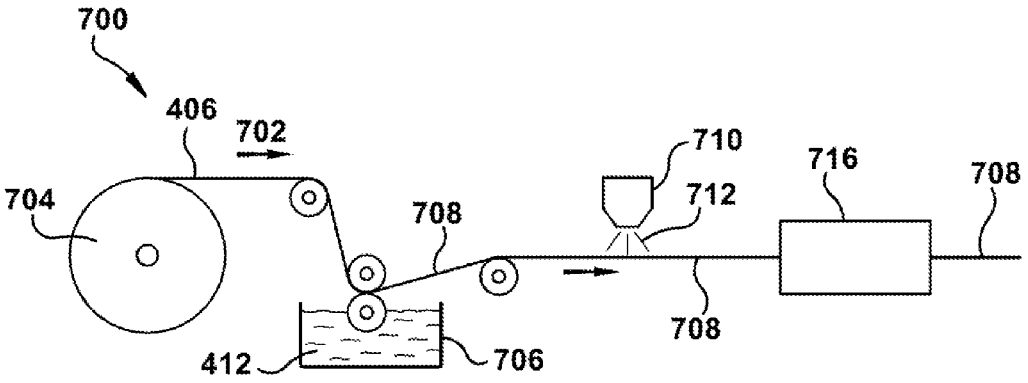
FIG. 7 is a schematic view of an exemplary embodiment of a shingle manufacturing apparatus that applies non-asphalt coating to a substrate of the shingle of FIG. 4.

The completed substrate, in this case a standard completed fiberglass roofing mat, is used to manufacture an asphalt roofing shingle. The non-asphalt coating 412 that is substituted for the asphalt of the shingle may be applied to the completed substrate 406 in any suitable manner, which may vary depending on the desired outcome and the type of non-asphalt coating being applied. FIG. 7 shows an exemplary embodiment of a shingle manufacturing apparatus 700 for applying the non-asphalt coating 412 to the substrate 406 to substitute for the roofing asphalt. The illustrated manufacturing process involves passing a continuous sheet of the completed substrate 406 in a machine direction 702 through a series of shingle manufacturing operations. The substrate 406 may move at any suitable speed.

Figure 8:
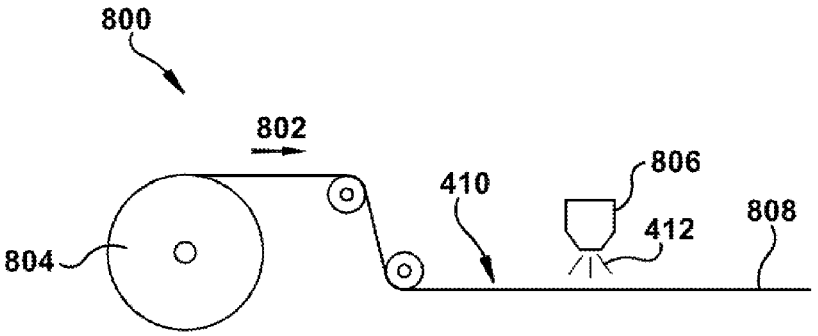
FIG. 8 is a schematic view of another exemplary embodiment of a shingle manufacturing apparatus that applies non-asphalt coating to a substrate of the shingle of FIG. 4.
Figure 9:
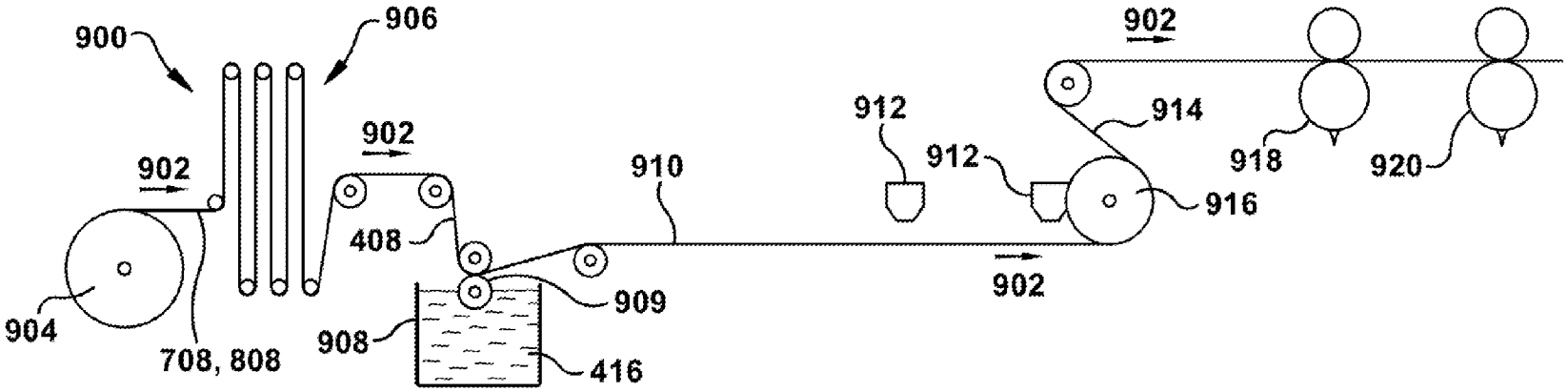
FIG. 9 is a schematic view of another exemplary embodiment of a shingle manufacturing apparatus for manufacturing the shingle of FIG. 4.

While FIGS. 7-9 illustrate shingle manufacturing processes in which the coating 412 is applied to the substrate prior to the application of the filled asphalt coating. In other embodiments, the asphalt coating may be applied prior to the coating 412. For example, the roofing filled asphalt coating may be applied in a manner in which the substrate is partially or minimally impregnated with the asphalt and the coating 412 is applied in a subsequent step to fully impregnate the substrate. In another embodiment, the coating 412 may be applied to the mat prior to the asphalt coating as a layer or sheet on the bottom face of the substrate, to substitute for the roofing asphalt. In one version of this embodiment, application of the asphalt coating onto the substrate causes the layer or sheet of non-asphalt coating to melt and impregnate into the substrate.

FIG. 7 illustrates an exemplary embodiment of a shingle manufacturing apparatus 700 for forming a shingle component 708. Referring to FIG. 7, in a first step of the shingle manufacturing process, the continuous sheet of completed substrate 406 is payed out from a roll 704. Alternatively, the sheet of completed substrate 406 can be delivered or fed into the shingle manufacturing process by some other manner. The sheet of completed substrate 406 is passed from the roll 704 or other supply through a coater 706 where the substrate 406 is flooded or saturated with the coating 412 (instead of a roofing asphalt coating) to form the shingle component 708. The saturated shingle component 708 is then optionally passed to a binder applicator 710 where a binder solution 712 is applied to the saturated shingle component 708. Any suitable thermosetting or thermoplastic binder may be used, such as for example, traditional phenolic-formaldehyde binders, as well as the more recent formaldehyde-free binders, including polyacrylic binders and carbohydrate, starch or bio-based binders. In an alternative embodiment, the coating 412 and optional binder solution 712 may be applied to the substrate 406 simultaneously or as a single solution. In another alternative embodiment, the binder is optional and the non-asphalt coating is configured to adhere to the substrate 406 without use of a separate binder composition.

The shingle component 708 is then optionally passed through an oven 716 that is heated to a suitable temperature to cure the binder 712. In the exemplary embodiment, the resulting shingle component 708 is fully impregnated with the non-asphalt coating 412 and does not have a discrete layer of the coating 412 on either the top face 408 or bottom face 410. In other embodiments of FIG. 7, a discrete layer of non-asphalt coating may be formed. In the embodiment of FIG. 7, the coating 412 substitutes for the roofing asphalt that would have saturated the substrate.

FIG. 8 shows another exemplary embodiment of a shingle manufacturing apparatus 800. The apparatus 800 substitutes coating 412 for the roofing asphalt in the substrate 406. As with the apparatus 700 of FIG. 7, the illustrated shingle manufacturing process of FIG. 8 involves passing a continuous sheet of the substrate 406 in a machine direction 802 through a series of shingle manufacturing operations to form a shingle component 808. The substrate 406 may move at any desired speed.

In a first step of the shingle manufacturing process, the continuous sheet of completed substrate 406 is payed out from a roll 804. Alternatively, the sheet of completed substrate 406 can be delivered or fed into the shingle manufacturing process by some other manner. The sheet of completed substrate 406 is passed from the roll 804 through a coater 806 where the coating 412 is selectively applied only to a portion of the substrate 406 to form a coated shingle component 808.

In the exemplary embodiment, the coater 806 selectively applies the coating 412 to the entire bottom face 410 of the substrate 406 to substitute for roofing asphalt on at least the bottom face 410. The coater 806, however, may be configured to selectively apply the coating 412 to only a portion of the bottom face 410 or to other portions of the substrate 406, such as to the top face 408 instead of or along with the bottom face 410. The coater 806 can be configured to apply the coating 412 in any suitable manner such as, for example, spraying, rolling, or fountain coating. The amount of coating 412 and how long the coating is applied to the substrate 406 can be modified as desired. In this process, the coating 416 could fully impregnate the substrate 406, partially impregnate the substrate, or not impregnate the substrate to completely, partially, or not substitute for the roofing asphalt in the substrate 406. The process may also provide a discrete layer of coating 412 on the bottom face 410 with a thickness of the layer that can be varied as desired. In the illustrated embodiment, the coating 412 partially impregnates the substrate 406 and forms the bottom non-asphalt layer 414 of the shingle 400. The shingle component 808 is optionally heated to a suitable temperature to cure the coating on the shingle component.

FIG. 9 shows an exemplary embodiment of an apparatus 900 for completing the manufacturing of an asphalt-based roofing shingle with the shingle components 708 and/or 808. The illustrated manufacturing process 900 involves passing a shingle component 708 and/or 808 that does not include roofing asphalt in a machine direction 902 through a series of further shingle manufacturing operations. The shingle component 708 and/or 808 may move at any desired speed. In the exemplary embodiment, the shingle component 708 and/or 808 usually moves at a speed of at least about 200 feet/minute (61 meters/minute), and typically at a speed within the range of between about 450 feet/minute (137 meters/minute) and about 800 feet/minute (244 meters/minute).

In the manufacturing process, the continuous sheet of shingle component 708 and/or 808 is payed out from a roll 904 or other supply. Alternatively, the apparatus 900 may be a portion of an in-line manufacturing process that includes the apparatus 700 and/or the apparatus 800 for applying the coating 412 to the substrate 406 instead of roofing asphalt and make the roofing component 708 and/or 808. Thus, the shingle component 708 and/or 808 may not arrive at the apparatus 900 via the roll 904, but instead is supplied to the apparatus in another suitable manner. The shingle component 708 and/or 808 is passed from the roll 904 through an accumulator 906. The accumulator 906 allows time for splicing one roll 904 of substrate 406 to another, during which time the shingle component 708 and/or 808 within the accumulator 906 is fed to the manufacturing process so that the splicing does not interrupt manufacturing.

Next, the shingle component 708 and/or 808 is passed through a coater 908 where a coating of roofing asphalt 416 is applied to the top face 408 of the shingle component 708 and/or 808. The roofing asphalt 416 may be applied in any suitable manner. In the illustrated embodiment, a supply of hot, melted asphalt 416 is applied to the top face 408 of the shingle component 708 and/or 808 at immediately prior to a pair of rollers 909. The shingle component 708 and/or 808 moves between the nip point of the two rollers 909. The rollers 909 completely cover the top face 408 with a tacky coating of roofing asphalt 416 while no asphalt contacts the bottom face 410 of the substrate 406. However, in other embodiments, the roofing asphalt 416 could be sprayed on, rolled on, or applied to the shingle component 708 and/or 808 by other means. To the extent that the shingle component 708 and/or 808 is not fully impregnated with the coating 412, the asphalt 416 may impregnate the substrate 406 where the substrate is not impregnated with the coating 412, in addition to forming the top asphalt layer 418. If the substrate 406 of the shingle component 708 and/or 808 is fully impregnated, or substantially fully impregnated, with the coating 412, the asphalt 416 may adhere to the top face 408 and/or to the non-asphalt coating with little or no impregnation and form the top asphalt layer 418 resulting in an asphalt coated shingle component 910. Typically the asphalt 416 is highly filled with a ground mineral filler material, amount to at least about 60 percent by weight of the asphalt/filler combination. In one embodiment, the asphalt 416 is in a range from about 350 degree F. to about 400 degree F. In another embodiment, the asphalt 416 may be more than 400 degree F. or less than 350 degree F. The asphalt coated shingle component 910 exits the coater 908 with the asphalt 416 remaining hot.

The asphalt coated shingle component 910 may then be passed beneath one or more granule dispensers 912 for the application of granules to the top asphalt layer 418 of the asphalt-coated shingle component 910. The granule dispensers 912 may be of any type suitable for depositing granules onto the asphalt-coated shingle component 910. Any desired number of dispensers may be used.

After the granules are deposited on the asphalt-coated shingle component 910 by the one or more dispensers 912, the sheet 910 becomes a granule-covered shingle component 914. The granule-covered shingle component 914 may then be turned around a slate drum 916 to press the granules into the top asphalt layer 418 and to temporarily invert the sheet so that the excess granules will fall off and will be recovered and reused. The shingle component 910 may also pass through a set of press rolls to complete the embedment of the granules into the filled asphalt coating and through a series of cooling steps after the press rolls and prior to being cut.

The granule-covered shingle component 914 may subsequently be fed through a first cutter 918. The first cutter 918 may cut a series of notches 422 in the granule-covered shingle component 914 to form tabs 424 (see FIG. 4). Further downstream, the granule-covered shingle component 914 may be passed into contact with a second cutter 920 that cuts the granule-covered shingle component 914 into individual shingles 400.

In addition to the property benefits to the shingle 400 provided by the coating 412, having the bottom face of the shingle 400 be asphalt-free, or substantially asphalt free (e.g. greater than 95% asphalt-free) may provide additional benefits. For example, eliminating asphalt 416 on the bottom face may reduce the amount of asphalt used in the production of the shingle 400. Using less asphalt 416 results in a lighter shingle 400 which makes for easier handling and transporting of the shingles and the production process can better control the amount of asphalt 416 being used and the overall weight in the shingle. Alternatively, the amount of asphalt normally applied to the bottom face can be applied to the top face 408 to create a thicker top asphalt layer 418. The thicker top asphalt layer 418 provides additional protection against the elements without increasing the weight of the shingle 400 beyond traditional shingles. Furthermore, the elimination of asphalt on the back face 410 of the substrate 406 of the shingle 400 may make the use of a back coating of sand or mica, and release tape, optional since there is less risk of shingles sticking to each other when packaged and stored at elevated temperatures. Still further, by eliminating the need to impregnate the substrate with the filled asphalt coating, the type of filler used in the filled asphalt coating may be modified without concerns that the use of a modified filler may degrade the substrate.

Figure 10:
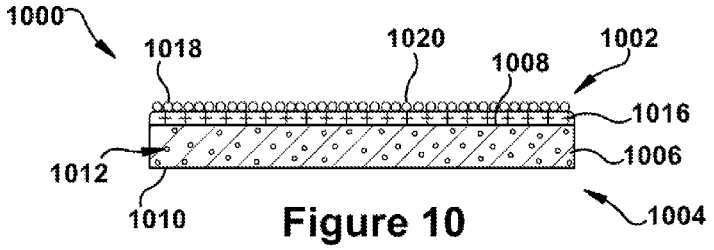
FIG. 10 is section view of another exemplary embodiment of a roofing shingle according to the present invention.

Referring to FIG. 10, an exemplary embodiment of a roofing shingle 1000 is illustrated. The roofing shingle 1000 is similar to the roofing shingle 400 in that the shingle 1000 is generally planar and includes a top surface 1002, a bottom surface 1004, and includes a substrate 1006 having a top face 1008, a bottom face 1010 generally parallel to the top face and a non-asphalt coating 1012. The shingle 1000 also includes an asphalt coating 1016 that forms a discrete top asphalt layer 1018 covering the entire the top face 1008 of the substrate, or substantially the entire top face (e.g. greater than 95% of the top face), and a layer of granules 1020 that covers, and may be partially embedded into, the top asphalt layer 1018. As with the shingle 400, the bottom face 1010 of the substrate 1006 is asphalt-free, or substantially asphalt-free. The substrate 1006 of the shingle 1000 is fully, or nearly fully impregnated, with non-asphalt coating 1012. Little or no impregnation of the substrate 1006 by the asphalt 1016 occurs. The substrate 1006 could be coated with non-asphalt coating 412 by the process illustrated in FIG. 7, for example.

Figure 11:
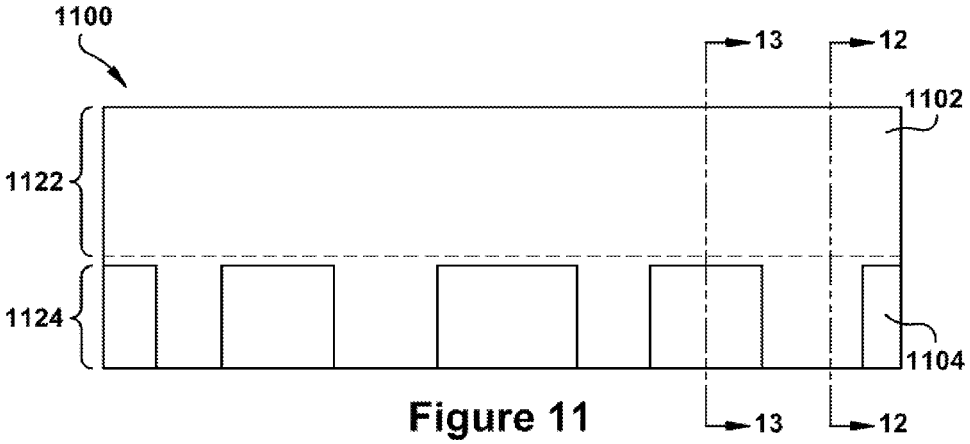
FIG. 11 is top view of another exemplary embodiment of a roofing shingle according to the present invention.
Figure 12:
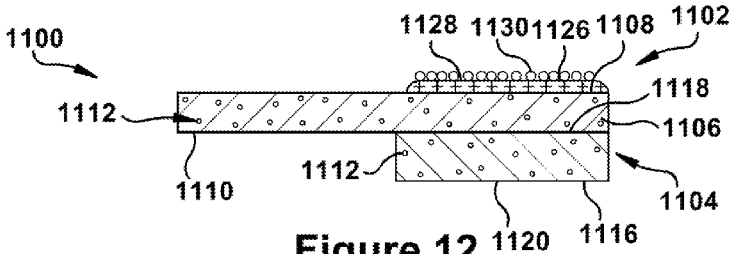
FIG. 12 is section view of the roofing shingle of FIG. 11 taken along the line 12-12 of the roofing shingle shown in FIG. 11.
Figure 13:
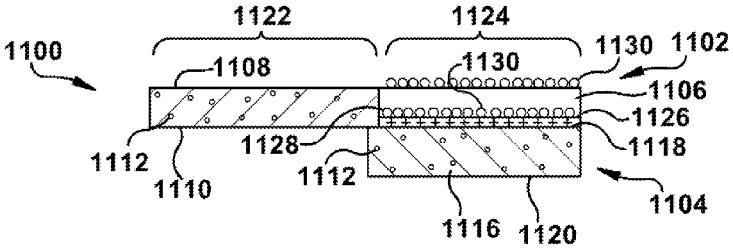
FIG. 13 is section view of the roofing shingle of FIG. 11 taken along the line 13-13 of the roofing shingle shown in FIG. 11.

Referring to FIGS. 11 and 12, an exemplary embodiment of a roofing shingle 1100 is illustrated. The roofing shingle 1100 is a laminated shingle including an overlay sheet 1102 laminated to an underlay sheet 1104. The overlay sheet 1102 includes a substrate 1106 having a top face 1108, a bottom face 1110 generally parallel to the top face. The substrate 1106 is impregnated with a coating 1112. The underlay sheet 1104 includes a substrate 1116 having a top face 1118 and a bottom face 1120 generally parallel to the top face. The substrate 1116 is impregnated with the non-asphalt coating 1112.

The overlay sheet 1102 includes a headlap portion 1122 and an exposed portion 1124. The overlay sheet 1102 overlaps the underlay sheet in the exposed portion. When installed on a roof, the exposed portion 1124 of the overlay sheet is configured to be visible and exposed to the elements while the headlap portion 1122 is configured to be underneath the exposed portion of the next course of shingles.

The shingle 1100 also includes an asphalt coating 1126 that forms a discrete top asphalt layer 1128 on the top face 1108 of the exposed portion 1124 of the overlay sheet 1102 and the top face 1118 of the underlay sheet 1104. A granule layer 1130 may cover, and may be partially embedded into, the top asphalt layer 1118 on the overlay sheet 1102 and the underlay sheet 1104.

The bottom face 1110 of the overlay sheet 1102 and the bottom face 1120 of the underlay sheet 1104 are asphalt-free, or substantially asphalt-free. In addition, the non-asphalt coating 1112 fully impregnates the overlay sheet substrate 1106 and the underlay sheet substrate 1116 to substitute for the roofing asphalt of the shingle. As such, a discrete non-asphalt layer (i.e. separate from the impregnating coating) is not formed on the bottom face 1110 of the overlay sheet 1102 or the bottom face 1120 of the underlay sheet 1104. In other embodiments, however, the non-asphalt coating need not fully impregnate either substrate 1106, 1116 and a discrete non-asphalt layer may be formed on either bottom face 1100, 1120.

Unlike the shingle 1000, however, a portion of the top face 1108 of the overlay sheet 1102 is asphalt-free, or substantially asphalt-free. In particular, in the exemplary embodiment, the headlap portion 1122 of the shingle 1000 is asphalt-free, or substantially asphalt free. The substrates 1106, 1116 could be coated with non-asphalt coating 1112 by the process illustrated in FIG. 7, for example to substitute the coating for the asphalt. The asphalt 1116 could be selectively applied to the substrates 1106, 1116 by a process similar to the process of FIG. 9. For example, a supply of hot, melted asphalt 1116 could be selectively applied to a portion of the top face 1108 of the overlay substrate 1106 immediately prior to the pair of rollers 909 such that when the substrate moves between the nip point of the rollers, the asphalt 1116 does not cover the headlap portion 1122 of the overlay substrate 1106.

Figure 14:
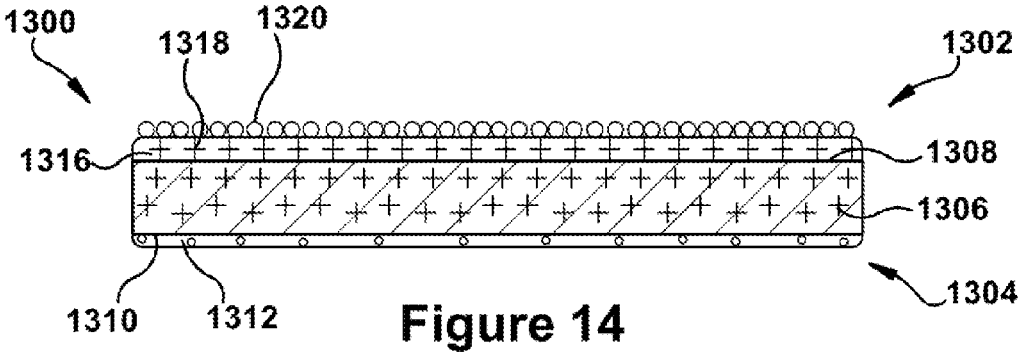
FIG. 14 is section view of another exemplary embodiment of a roofing shingle according to the present invention.

Referring to FIG. 14, an exemplary embodiment of a roofing shingle 1300 is illustrated. The roofing shingle 1300 is similar to the roofing shingle 1000 of FIG. 10 in that the shingle 1300 has a top surface 1302, a bottom surface 1304, and a substrate 1306 that includes a top face 1308, a bottom face 1310 generally parallel to the top face. The shingle 1300 has a non-asphalt coating 1312 on the bottom face 1310. The shingle 1300 also includes asphalt 1316 that forms a discrete top asphalt layer 1318 on the top face 1308 of the substrate and a layer of granules 1320 that covers, and may be partially embedded into, the top asphalt layer 1318. As with the shingle 1000, the bottom face 1310 of the substrate 1306 is asphalt-free, or substantially asphalt-free. Unlike the shingle 1000, however, the non-asphalt coating 1312 does not impregnate, or only minimally impregnates, the substrate 1306. The substrate 1306 is fully impregnated, or substantially fully impregnated, with the asphalt 1316.

The above description of specific embodiments has been given by way of example. From the disclosure given, those skilled in the art will not only understand the general inventive concepts and attendant advantages, but will also find apparent various changes and modifications to the structures and methods disclosed. For example, the general inventive concepts are not typically limited to any roofing application. Thus, for example, use of the inventive concepts to both domestic and commercial roofing applications, are within the spirit and scope of the general inventive concepts. As another example, although the embodiments disclosed herein have been primarily directed to asphalt-based roofing shingles, the general inventive concepts could be readily extended to any roofing material which could benefit from the use of a non-asphalt coated substrate. Furthermore, the general inventive concepts could be readily applied to various shingle designs, such as for example, single layer, three tab shingles or multi-layer, laminate shingles. It is sought, therefore, to cover all such changes and modifications as fall within the spirit and scope of the general inventive concepts, as described and claimed herein, and equivalents thereof.

The invention claimed is:

1. A roofing material, comprising:

a substrate having a top face and a bottom face;

a non-asphalt coating applied to the substrate;

an asphalt layer covering at least a portion of the top face; and a surface layer of granules adhered to the asphalt layer;

wherein the substrate is fully impregnated with the non-asphalt coating such that substantially no asphalt from the asphalt layer impregnates the substrate; and wherein the bottom face of the substrate is substantially asphalt free.

2. The roofing material of claim 1 wherein the non-asphalt coating improves at least one shingle property of the group of tear resistance, tensile strength, nail pull resistance, wind resistance, fire resistance, shingle stiffness, cold curling resistance, masking ability, and shingle water shedding ability.

3. The roofing material of claim 1 wherein the non-asphalt coating includes at least one of the group of calcium carbonate, viscosity modifiers, dispersants, biocides, acrylic resins, clays, wollastonite, and powdered resins.

4. The roofing material of claim 1 wherein the roofing material is an asphalt roofing shingle.

* * * * *